US008641455B2

(12) United States Patent
Lan

(10) Patent No.: US 8,641,455 B2
(45) Date of Patent: Feb. 4, 2014

(54) UNIVERSAL SERIAL BUS CONNECTOR PERPENDICULARLY MOUNTED ON A PRINTED CIRCUIT BOARD

(75) Inventor: Rong-Qin Lan, Guang-Dong (CN)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 31 days.

(21) Appl. No.: 13/541,652

(22) Filed: Jul. 3, 2012

(65) Prior Publication Data

US 2014/0011378 A1 Jan. 9, 2014

(51) Int. Cl.
*H01R 24/00* (2011.01)

(52) U.S. Cl.
USPC ..... 439/660

(58) Field of Classification Search
USPC ..... 439/660, 658, 83–89, 607.01
See application file for complete search history.

(56) References Cited

U.S. PATENT DOCUMENTS

| | | | | |
|---|---|---|---|---|
| 8,113,882 | B1 * | 2/2012 | Chen | 439/607.01 |
| 8,475,218 | B2 * | 7/2013 | Zheng et al. | 439/660 |
| 2010/0173529 | A1 * | 7/2010 | He et al. | 439/660 |
| 2010/0330849 | A1 * | 12/2010 | Wang et al. | 439/701 |
| 2011/0159746 | A1 * | 6/2011 | He | 439/660 |
| 2011/0235293 | A1 * | 9/2011 | Nagata et al. | 361/767 |
| 2012/0149244 | A1 * | 6/2012 | Zheng et al. | 439/658 |

* cited by examiner

*Primary Examiner* — Chandrika Prasad
(74) *Attorney, Agent, or Firm* — Cheng-Ju Chiang

(57) ABSTRACT

A Universal Serial Bus connector includes an insulating housing which has a base body, a first tongue and a second tongue extending forward from a lower portion and a bottom of the base body, a plurality of first terminals disposed in the first tongue and each having a contact slice, a plurality of second terminals disposed in the second tongue and each having an elastic arm electrically contacting with the corresponding contact slice, and a shell mounted rearward to the base body with the first tongue being located in the shell and the second tongue resisting under the shell. Soldering tails of the second terminals project out from a front end of the second tongue and are transversely in alignment with one another for being soldered onto a printed circuit board so as to make the Universal Serial Bus connector perpendicularly mounted to the printed circuit board.

15 Claims, 4 Drawing Sheets

UNIVERSAL SERIAL BUS CONNECTOR PERPENDICULARLY MOUNTED ON A PRINTED CIRCUIT BOARD

BACKGROUND OF THE INVENTION

1. Field of the Invention

The present invention relates to an electrical connector, and more particularly to a Universal Serial Bus connector.

2. The Related Art

A USB (Universal Serial Bus) connector is often used in an electronic product, such as a notebook computer, a mobile phone and so on, for realizing data transmission between the electronic product and corresponding peripheral devices thereof. The rapid development of electronic technology calls for more stringent requirements to diversified configuration of the USB connector. However, at present, a single soldering type is often between the USB connector and a printed circuit board of the electronic product. That is to say, the USB connector is often horizontally mounted on the printed circuit board placed levelly. Therefore, in order to meet different demands of the development of modern electronic technology, now provide an improved USB connector which is capable of being vertically mounted on the printed circuit board placed levelly, and has a simple soldering process with the printed circuit board and a lower manufacture cost.

SUMMARY OF THE INVENTION

Accordingly, an object of the present invention is to provide a Universal Serial Bus connector adapted for being perpendicularly mounted to a printed circuit board which defines a mating window. The Universal Serial Bus connector includes an insulating housing, a terminal group and a shell. The insulating housing has a base body, a first tongue extending forward from a lower portion of a front of the base body, and a second tongue extending forward from a bottom of the front of the base body and parallelly spaced from the first tongue. A top surface of the first tongue defines a plurality of first passages arranged at regular intervals along a transverse direction thereof and each extending longitudinally to penetrate through a rear of the base body. A bottom surface of the second tongue defines a plurality of second passages arranged in accordance with the first passages and each extending longitudinally to penetrate through the second tongue. Rear ends of the first passage and the corresponding second passage are communicated with each other in the base body. The terminal group includes a plurality of first terminals and a plurality of second terminals disposed in the second passages of the insulating housing. Each first terminal has a long contact slice levelly disposed in the rear of the first passage of the insulating housing, and a contact arm extending forward from a front end of the contact slice and curved upward to elastically project beyond the top surface of the first tongue. Each second terminal has a fastening arm, an extension arm extending rearward and inclining upward from a rear end of the fastening arm, an elastic arm curvedly extending upward from a rear end of the extension arm, and a soldering tail bent downward from a front end of the fastening arm. The elastic arm is disposed in the rear of the second passage and electrically abuts against a bottom face of the contact slice of the corresponding first terminal, and the soldering tail projects out from a front end of the second passage and further beyond the bottom surface of the second tongue. The soldering tails are transversely in alignment with one another. The shell has a top plate, a bottom plate and a pair of side plates connected together to define a mating mouth. The shell is mounted rearward to the base body of the insulating housing with the first tongue being located in the mating mouth and the second tongue resisting under the bottom plate. Front ends of the pair of side plates are provided with a pair of soldering feet. The Universal Serial Bus connector is perpendicularly mounted to the printed circuit board by means of soldering the soldering tails of the second terminals and the soldering feet of the shell to the printed circuit board and around the mating window. The mating mouth of the Universal Serial Bus connector is communicated with the mating window of the printed circuit board.

As described above, the first terminals and the second terminals are assembled in the first passages and the second passages of the insulating housing respectively to make the contact slices and the corresponding elastic arms electrically connect with each other in the base body, so as to realize an electrical connection between the first terminals and the corresponding second terminals. Therefore, as long as the soldering tails of the second terminals are soldered onto the printed circuit board, an electrical connection can be realized between the terminal group and the printed circuit board. So, the Universal Serial Bus connector is perpendicularly mounted to the printed circuit board conveniently and simply, and needs a lower cost.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
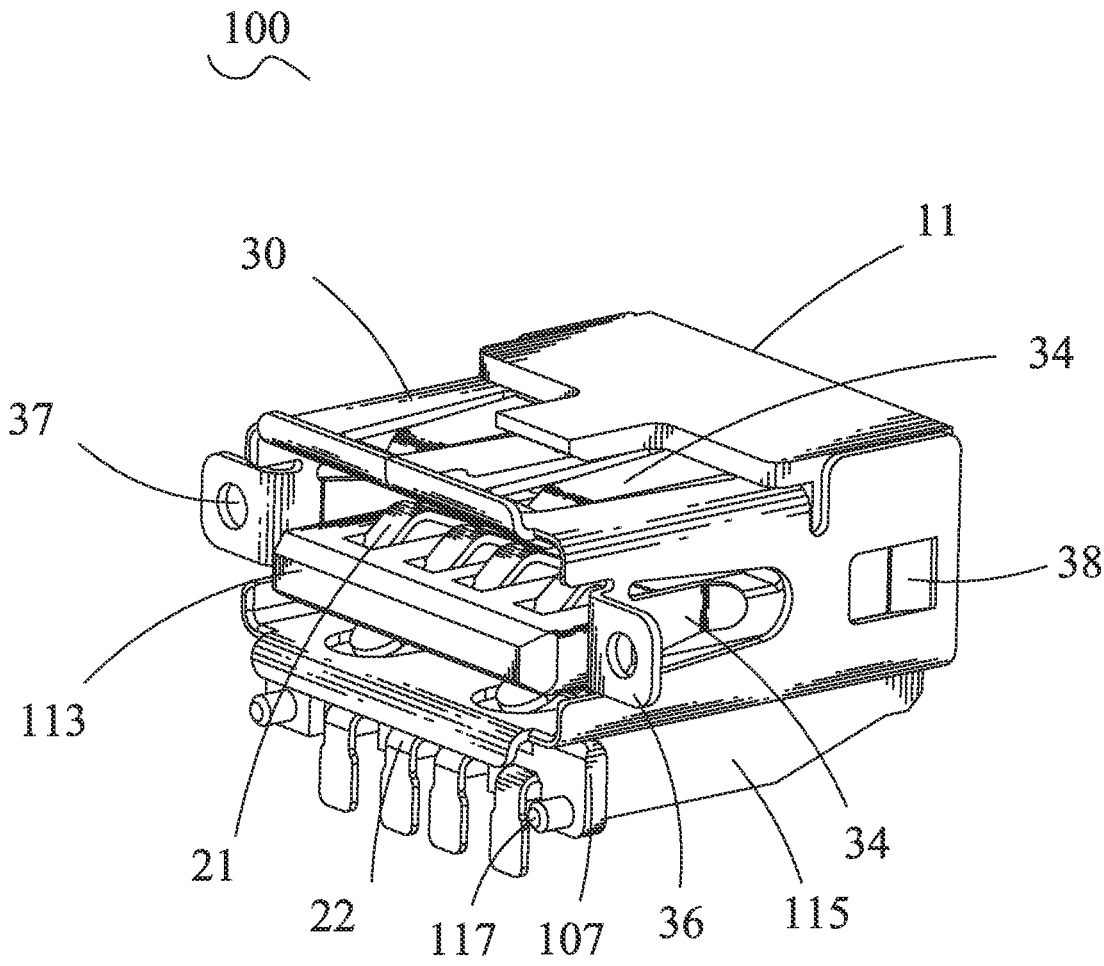
FIG. 1 is a perspective view of a Universal Serial Bus connector according to a first embodiment of the present invention.
Figure 2:
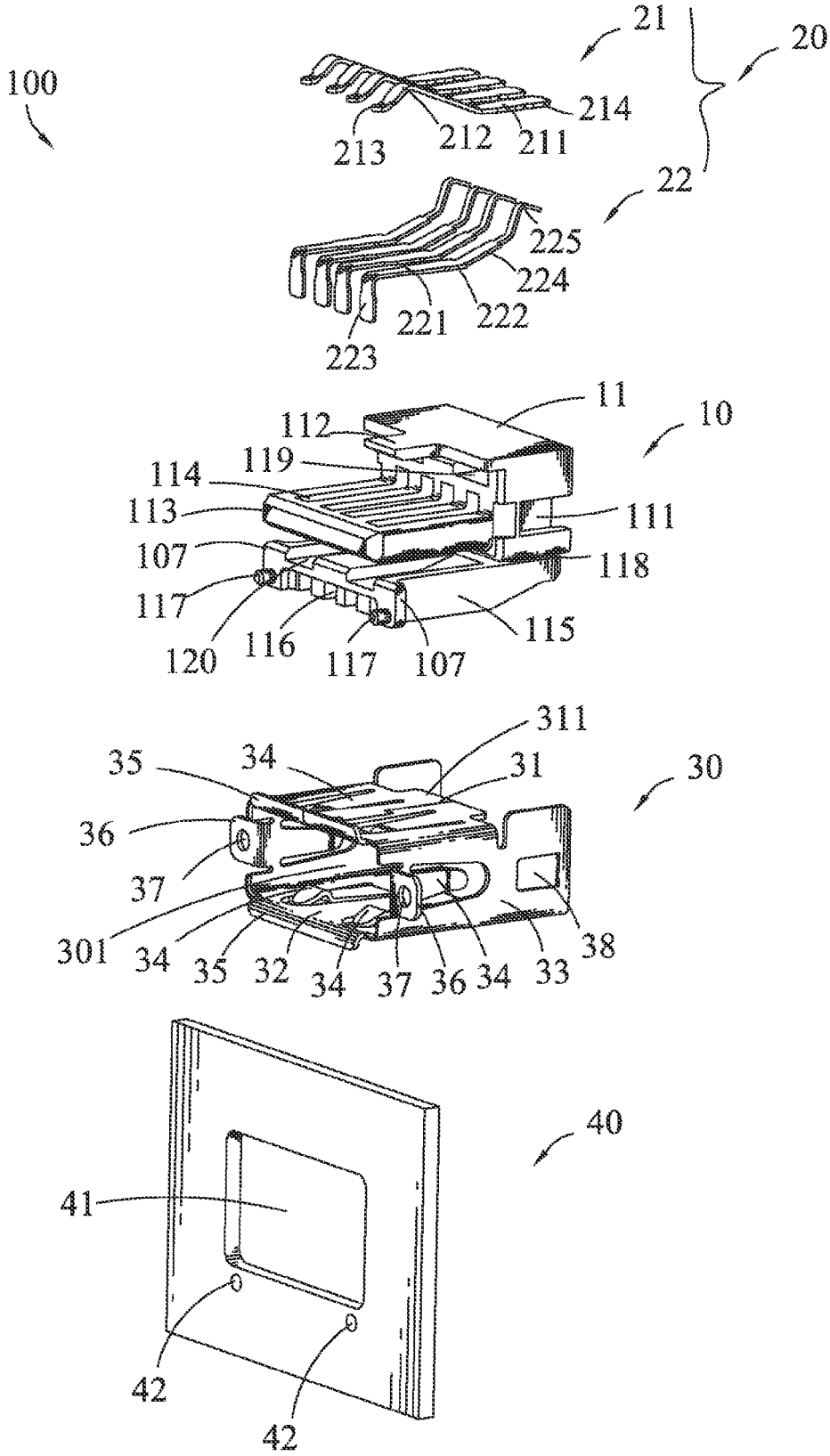
FIG. 2 is an exploded view of the Universal Serial Bus connector of FIG. 1, wherein a printed circuit board is shown.

With reference to FIG. 1 and FIG. 2, a Universal Serial Bus connector 100 in accordance with a first embodiment of the present invention is adapted for being perpendicularly mounted to a printed circuit board 40 defining a mating window 41 therein. The Universal Serial Bus connector 100 includes an insulating housing 10, a terminal group 20 disposed in the insulating housing 10, and a shell 30 enclosing the insulating housing 10.

Referring to FIGS. 1-4, the insulating housing 10 has a base body 11, a first tongue 113 extending forward from a lower portion of a front of the base body 11, and a second tongue 115 extending forward from a bottom of the front of the base body 11 and parallelly spaced from the first tongue 113. A top surface of the first tongue 113 defines a plurality of first passages 114 arranged at regular intervals along a transverse direction thereof and each extending longitudinally to penetrate through a rear of the base body 11. A bottom surface of the second tongue 115 defines a plurality of second passages 116 arranged in accordance with the first passages 114 and each extending longitudinally to penetrate through the second tongue 115. Rear ends of the first passage 114 and the corresponding second passage 116 are communicated with each other in the base body 11.

The terminal group 20 includes a plurality of first terminals 21 and a plurality of second terminals 22. Each of the first terminals 21 has a long contact slice 211 levelly disposed in the rear of the first passage 114 of the insulating housing 10, and a contact arm 212 extending forward from a front end of the contact slice 211 and curved upward to elastically project beyond the top surface of the first tongue 113. The second terminals 22 are disposed in the second passages 116 of the insulating housing 10. Each second terminal 22 has a fastening arm 221, an extension arm 224 extending rearward and inclining upward from a rear end of the fastening arm 221, an elastic arm 225 curvedly extending upward from a rear end of the extension arm 224, and a soldering tail 223 bent downward from a front end of the fastening arm 221. The elastic arm 225 is disposed in the rear of the second passage 116 and electrically abuts against a bottom face of the contact slice 211 of the corresponding first terminal 21. The soldering tail 223 projects out from a front end of the second passage 116 and further beyond the bottom surface of the second tongue 115. The soldering tails 223 are transversely in alignment with one another.

The shell 30 has a top plate 31, a bottom plate 32 and a pair of side plates 33 connected together to define a mating mouth 301. The shell 30 is mounted rearward to the base body 11 of the insulating housing 10 with the first tongue 113 being located in the mating mouth 301 and the second tongue 115 resisting under the bottom plate 32. Front ends of the pair of side plates 33 are provided with a pair of soldering feet 36. In assembly, the Universal Serial Bus connector 100 is perpendicularly mounted to the printed circuit board 40 by means of soldering the soldering tails 223 of the second terminals 22 and the soldering feet 36 of the shell 30 to the printed circuit board 40 and around the mating window 41. The mating mouth 301 of the Universal Serial Bus connector 100 is communicated with the mating window 41 of the printed circuit board 40.

Figure 3:
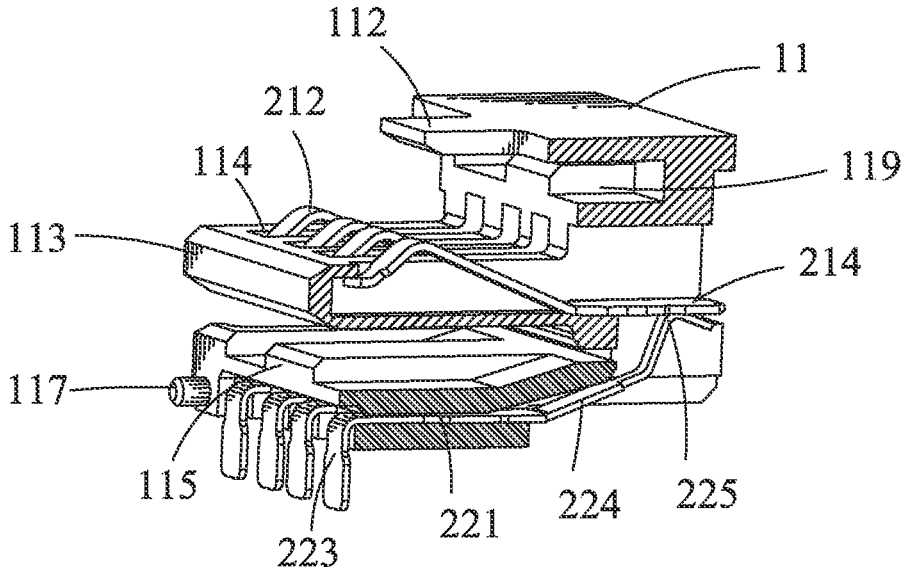
FIG. 3 is a sectional view of the Universal Serial Bus connector except a shell of FIG. 1.

Referring to FIG. 2 and FIG. 3, a front end of the contact arm 212 of the first terminal 21 is further elongated forward to form a restraining tail 213 movably restrained in a front sidewall of the first passage 114 of the insulating housing 10. Two side edges of the contact slice 211 of the first terminal 21 oppositely protrude sideward to form first fixing barbs 214 fixed in two opposite inner sidewalls of the rear of the first passage 114. Two side edges of the fastening arm 221 of the second terminal 22 oppositely protrude sideward to form second fixing barbs 222 fixed in two opposite inner sidewalls of the second passage 116. The top plate 31, the side plates 33 and the bottom plate 32 of the shell 30 are punched inward to form a plurality of elastic strips 34. A top face of the second tongue 115 defines a pair of receiving fillisters 120 arranged in accordance with the elastic strips 34 of the bottom plate 32. Front edges of the top plate 31 and the bottom plate 32 are smoothly bent outward to form a guiding eave 35 respectively for guiding the insertion of an exterior mating connector (not shown) into the mating mouth 301 of the Universal Serial Bus connector 100.

Referring to FIG. 1 and FIG. 2, a top of the front of the base body 11 protrudes forward to form a restraining board 112 resisting on the top plate 31 of the shell 30. An upper portion of the front of the base body 11 defines two inserting fillisters 119 transversely arranged under the restraining board 112. Rear edges of the top plate 31 of the shell 30 extend rearward to form two inserting tails 311 inserted rearward in the inserting fillisters 119 of the base body 11 respectively. Two sides of the junction of the base body 11 and the second tongue 115 define two inserting slots 118 extending longitudinally to penetrate through two opposite outsides of the base body 11. Rears of the side plates 33 of the shell 30 are beyond rear edges of the top plate 31 and the bottom plate 32 to be attached on the two opposite outsides of the base body 11. Bottom edges of the rears of the side plates 33 are bent inward to be buckled in the inserting slots 118. The two opposite outsides of the base body 11 define a pair of buckling fillisters 111, and the rears of the side plates 33 are punched inward to form a pair of buckling wedges 38 buckled in the buckling fillisters 111 respectively.

Figure 4:
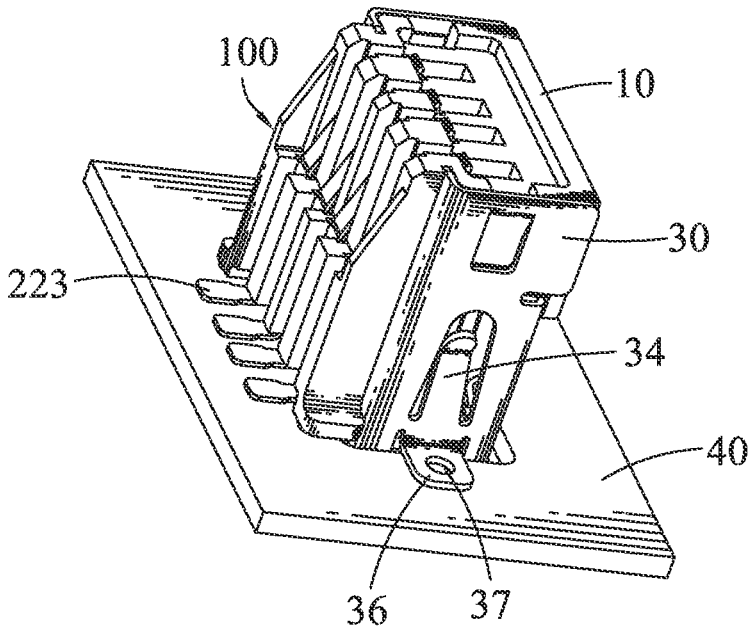
FIG. 4 is a perspective view showing that the Universal Serial Bus connector is mounted to the printed circuit board of FIG. 2.

Referring to FIG. 1, FIG. 2 and FIG. 4, the second tongue 115 of the insulating housing 10 substantially has the same width as that of the first tongue 113. Two opposite sides of a front of the second tongue 115 oppositely protrude sideward to form a pair of fastening blocks 107 with a pair of fastening pillars 117 protruding forward from front faces of the fastening blocks 107. The printed circuit board 40 further defines a pair of fastening holes 42 near to the mating window 41 for inserting the fastening pillars 117 therein. The front ends of the pair of side plates 33 of the shell 30 are die-cut and then oppositely bent outward to form the soldering feet 36 located in the same vertical plane with the soldering tails 223 of the second terminals 22. A pair of soldering holes 37 is opened in the soldering feet 36 for firmly soldering the soldering feet 36 on the printed circuit board 40.

Figure 5:
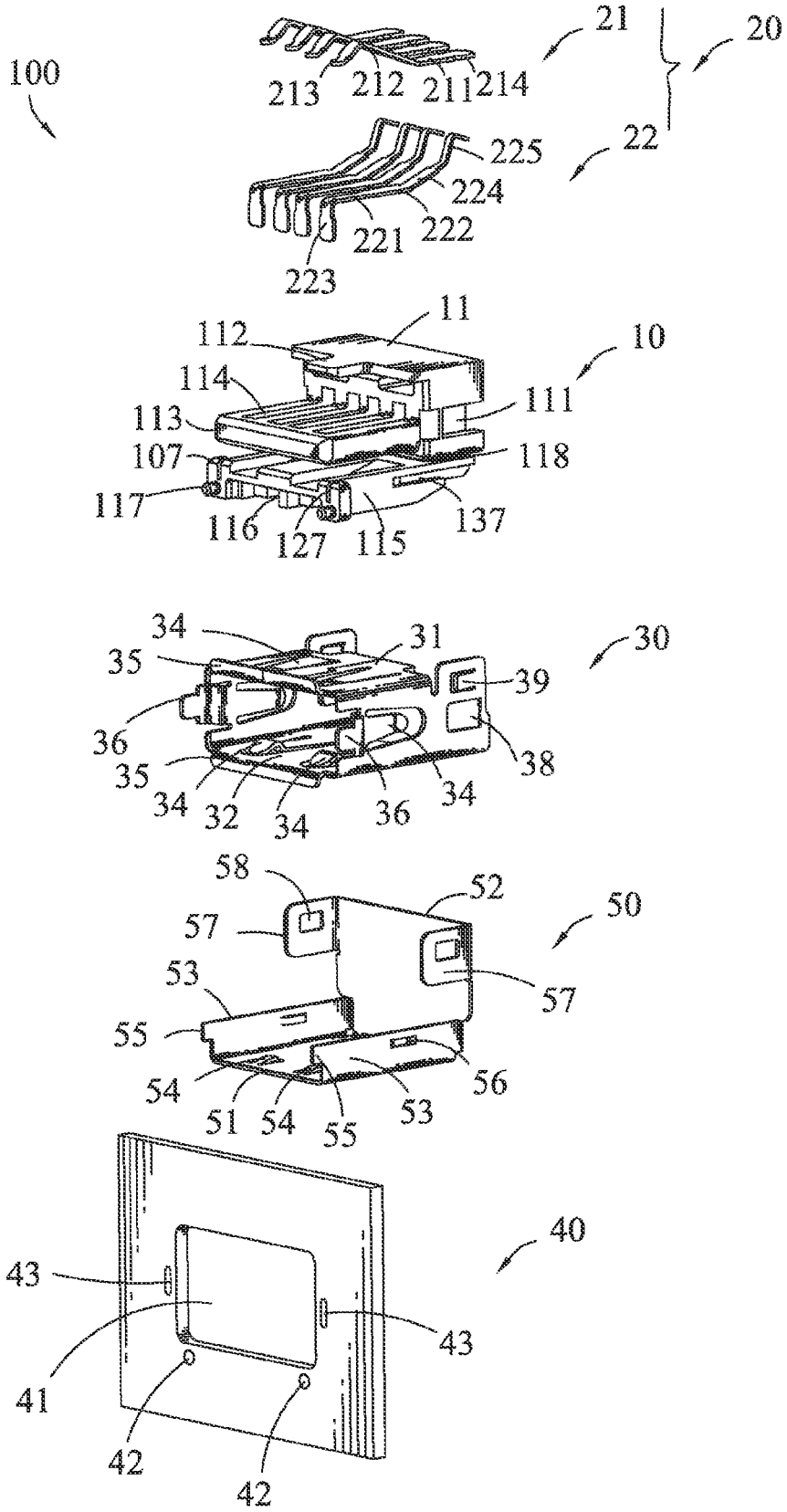
FIG. 5 is an exploded view of a Universal Serial Bus connector according to a second embodiment of the present invention, wherein a printed circuit board adapted for being connected with the Universal Serial Bus connector is shown.

With reference to FIG. 5, a Universal Serial Bus connector 100 according to a second embodiment of the present invention is shown. The Universal Serial Bus connector 100 adapted for being perpendicularly mounted to a printed circuit board 40 has a similar structure to the one in the first embodiment. The differences are described hereinafter. The Universal Serial Bus connector 100 further includes a cover 50 which has a bottom cover plate 51 covered onto the bottom surface of the second tongue 115 of the insulating housing 10, a rear cover plate 52 covered onto a rear surface of the base body 11, and two lateral cover plates 53 bent upward from two opposite sides of the bottom cover plate 51 to be attached on two opposite side faces of the second tongue 115. Rear ends of the lateral cover plates 53 are bent towards each other to be soldered on a rear surface of the rear cover plate 52.

The front ends of the pair of side plates 33 of the shell 30 are die-cut and curved outward and then extend forward to form the soldering feet 36. The printed circuit board 40 further defines a pair of inserting holes 43 arranged near two opposite sides of the mating window 41. The soldering feet 36 of the shell 30 are inserted in the inserting holes 43 and then are soldered with the printed circuit board 40. A pair of fastening slots 127 is longitudinally opened in the fastening blocks 107 of the insulating housing 10. A front edge of each lateral cover plate 53 protrudes forward to form a fastening tail 55 inserted forward in the fastening slot 127. The two opposite side faces of the second tongue 115 define a pair of buckling grooves 137, and the lateral cover plates 53 are punched inward to form a pair of buckling bumps 56 buckled in the buckling grooves 137 respectively. The rears of the side plates 33 of the shell 30 are punched outward to form a pair of buckling slices 39. Top parts of two opposite side edges of the rear cover plate 52 bend forward to form a pair of holding plates 57 with a pair of buckling holes 58 opened for buckling the corresponding buckling slices 39 therein. Front parts of the bottom cover plate 51 of the cover 50 are punched upward to form two restricting portions 54 resisting against the bottom surface of the second tongue 115 of the insulating housing 10.

As described above, the first terminals 21 and the second terminals 22 are assembled in the first passages 114 and the second passages 116 of the insulating housing 10 respectively to make the contact slices 211 and the corresponding elastic arms 225 electrically connect with each other in the base body 11, so as to realize an electrical connection between the first terminals 21 and the corresponding second terminals 22. Therefore, as long as the soldering tails 223 of the second terminals 22 are soldered onto the printed circuit board 40, an electrical connection can be realized between the terminal group 20 and the printed circuit board 40. So, the Universal Serial Bus connector 100 is perpendicularly mounted to the printed circuit board 40 conveniently and simply, and needs a lower cost.

What is claimed is:

1. A Universal Serial Bus connector adapted for being perpendicularly mounted to a printed circuit board which defines a mating window, comprising:

an insulating housing having a base body, a first tongue extending forward from a lower portion of a front of the base body, and a second tongue extending forward from a bottom of the front of the base body and parallelly spaced from the first tongue, a top surface of the first tongue defining a plurality of first passages arranged at regular intervals along a transverse direction thereof and each extending longitudinally to penetrate through a rear of the base body, a bottom surface of the second tongue defining a plurality of second passages arranged in accordance with the first passages and each extending longitudinally to penetrate through the second tongue, rear ends of the first passage and the corresponding second passage being communicated with each other in the base body;

a terminal group comprising:

a plurality of first terminals of which each has a long contact slice levelly disposed in the rear of the first passage of the insulating housing, and a contact arm extending forward from a front end of the contact slice and curved upward to elastically project beyond the top surface of the first tongue, and a plurality of second terminals disposed in the second passages of the insulating housing, each second terminal having a fastening arm, an extension arm extending rearward and inclining upward from a rear end of the fastening arm, an elastic arm curvedly extending upward from a rear end of the extension arm, and a soldering tail bent downward from a front end of the fastening arm, wherein the elastic arm is disposed in the rear of the second passage and electrically abuts against a bottom face of the contact slice of the corresponding first terminal, and the soldering tail projects out from a front end of the second passage and further beyond the bottom surface of the second tongue, the soldering tails are transversely in alignment with one another; and a shell having a top plate, a bottom plate and a pair of side plates connected together to define a mating mouth, the shell being mounted rearward to the base body of the insulating housing with the first tongue being located in the mating mouth and the second tongue resisting under the bottom plate, front ends of the pair of side plates being provided with a pair of soldering feet;

wherein the Universal Serial Bus connector is perpendicularly mounted to the printed circuit board by means of soldering the soldering tails of the second terminals and the soldering feet of the shell to the printed circuit board and around the mating window, the mating mouth of the Universal Serial Bus connector is communicated with the mating window of the printed circuit board.

2. The Universal Serial Bus connector as claimed in claim 1, wherein a front end of the contact arm of the first terminal is further elongated forward to form a restraining tail movably restrained in a front sidewall of the first passage of the insulating housing.

3. The Universal Serial Bus connector as claimed in claim 2, wherein two side edges of the contact slice of the first terminal oppositely protrude sideward to form first fixing barbs fixed in two opposite inner sidewalls of the rear of the first passage, two side edges of the fastening arm of the second terminal oppositely protrude sideward to form second fixing barbs fixed in two opposite inner sidewalls of the second passage.

4. The Universal Serial Bus connector as claimed in claim 1, wherein a top of the front of the base body protrudes forward to form a restraining board resisting on the top plate of the shell, an upper portion of the front of the base body defines two inserting fillisters transversely arranged under the restraining board, rear edges of the top plate of the shell extend rearward to form two inserting tails inserted rearward in the inserting fillisters of the base body respectively.

5. The Universal Serial Bus connector as claimed in claim 4, wherein the top plate, the side plates and the bottom plate of the shell are punched inward to form a plurality of elastic strips, a top face of the second tongue defines a pair of receiving fillisters arranged in accordance with the elastic strips of the bottom plate.

6. The Universal Serial Bus connector as claimed in claim 4, wherein two sides of the junction of the base body and the second tongue define two inserting slots extending longitudinally to penetrate through two opposite outsides of the base body, rears of the side plates of the shell are beyond rear edges of the top plate and the bottom plate to be attached on the two opposite outsides of the base body, bottom edges of the rears of the side plates are bent inward to be buckled in the inserting slots.

7. The Universal Serial Bus connector as claimed in claim 6, wherein the two opposite outsides of the base body define a pair of buckling fillisters, the rears of the side plates are punched inward to form a pair of buckling wedges buckled in the buckling fillisters respectively.

8. The Universal Serial Bus connector as claimed in claim 1, wherein the second tongue of the insulating housing substantially has the same width as that of the first tongue, two opposite sides of a front of the second tongue oppositely protrude sideward to form a pair of fastening blocks, a pair of fastening pillars protrudes forward from front faces of the fastening blocks, the printed circuit board further defines a pair of fastening holes near to the mating window for inserting the fastening pillars therein.

9. The Universal Serial Bus connector as claimed in claim 1, wherein the front ends of the pair of side plates of the shell are die-cut and then oppositely bent outward to form the soldering feet located in the same vertical plane with the soldering tails of the second terminals, a pair of soldering holes is opened in the soldering feet for firmly soldering the soldering feet on the printed circuit board.

10. The Universal Serial Bus connector as claimed in claim 1, further comprising a cover which has a bottom cover plate covered onto the bottom surface of the second tongue of the insulating housing, a rear cover plate covered onto a rear surface of the base body, and two lateral cover plates bent upward from two opposite sides of the bottom cover plate to be attached on two opposite side faces of the second tongue, rear ends of the lateral cover plates are bent towards each other to be soldered on a rear surface of the rear cover plate.

11. The Universal Serial Bus connector as claimed in claim 10, wherein the front ends of the pair of side plates of the shell are die-cut and curved outward and then extend forward to form the soldering feet, the printed circuit board further defines a pair of inserting holes arranged near two opposite sides of the mating window, the soldering feet of the shell are inserted in the inserting holes and then are soldered with the printed circuit board.

12. The Universal Serial Bus connector as claimed in claim 10, wherein the second tongue of the insulating housing substantially has the same width as that of the first tongue, two opposite sides of a front of the second tongue oppositely protrude sideward to form a pair of fastening blocks, a pair of fastening slots is longitudinally opened in the fastening blocks, a front edge of each lateral cover plate protrudes forward to form a fastening tail inserted forward in the fastening slot.

13. The Universal Serial Bus connector as claimed in claim 10, wherein the two opposite side faces of the second tongue define a pair of buckling grooves, the lateral cover plates are punched inward to form a pair of buckling bumps buckled in the buckling grooves respectively.

14. The Universal Serial Bus connector as claimed in claim 10, wherein rears of the side plates of the shell are punched outward to form a pair of buckling slices, top parts of two opposite side edges of the rear cover plate bend forward to form a pair of holding plates with a pair of buckling holes opened for buckling the corresponding buckling slices therein.

15. The Universal Serial Bus connector as claimed in claim 10, wherein front parts of the bottom cover plate of the cover are punched upward to form two restricting portions resisting against the bottom surface of the second tongue of the insulating housing.

* * * * *